US008512882B2

(12) United States Patent
Bost et al.

(10) Patent No.: US 8,512,882 B2
(45) Date of Patent: Aug. 20, 2013

(54) CARBIDE CUTTING INSERT

(75) Inventors: John Bost, Franklin, TN (US); X. Daniel Fang, Brentwood, TN (US); David J. Wills, Brentwood, TN (US); Edwin Tonne, Murfreesboro, TN (US)

(73) Assignee: TDY Industries, LLC, Pittsburgh, PA (US)

( * ) Notice: Subject to any disclaimer, the term of this patent is extended or adjusted under 35 U.S.C. 154(b) by 931 days.

(21) Appl. No.: 11/676,394

(22) Filed: Feb. 19, 2007

(65) Prior Publication Data

US 2008/0196318 A1 Aug. 21, 2008

(51) Int. Cl.
*B32B 9/00* (2006.01)

(52) U.S. Cl.
USPC ..... 428/698; 51/307; 51/309; 428/325; 428/469; 428/472; 428/697; 428/699

(58) Field of Classification Search
USPC ..... 51/307, 309; 428/325, 469, 472, 428/697, 698, 699
See application file for complete search history.

(56) References Cited

U.S. PATENT DOCUMENTS

| | | | | |
|---|---|---|---|---|
| 2,299,207 | A | | 10/1969 | Bevillard |
| 3,471,921 | A | | 10/1969 | Feenstra |
| 3,490,901 | A | | 1/1970 | Hachisuka et al. |
| 3,581,835 | A | | 6/1971 | Stebley |
| 3,628,921 | A | | 12/1971 | Hill |
| 3,660,050 | A | | 5/1972 | Iler et al. |
| 3,746,456 | A | | 7/1973 | Hill |
| 3,757,879 | A | | 9/1973 | Wilder et al. |
| 3,785,783 | A | * | 1/1974 | Mynard et al. ..... 75/236 |
| 3,806,270 | A | | 4/1974 | Tanner et al. |
| 3,854,991 | A | | 12/1974 | Hale |
| 3,920,407 | A | | 11/1975 | Mynard et al. |
| RE28,645 | E | | 12/1975 | Aoki et al. |
| 3,942,954 | A | | 3/1976 | Frehn |
| 3,986,653 | A | | 10/1976 | Gilding |
| 3,989,558 | A | | 11/1976 | Mynard et al. |
| 4,009,027 | A | | 2/1977 | Naidich et al. |

(Continued)

FOREIGN PATENT DOCUMENTS

| | | |
|---|---|---|
| AT | 268706 B | 2/1996 |
| AU | 695583 | 2/1998 |

(Continued)

OTHER PUBLICATIONS

Tracey et al "Development of Tungsten Carbide-Cobalt-Ruthenium Cutting Tools for Machining Steels" Proceedings Annual Microprogrammia Workshop vol. 14, 1981, p. 281-292.

(Continued)

*Primary Examiner* — Archene Turner
(74) *Attorney, Agent, or Firm* — K & L Gates LLP; Patrick J. Viccaro; John E. Grosselin, III

(57) ABSTRACT

Cutting tools and cutting inserts having a wear resistant coating on a substrate comprising a metal carbide particle and a binder. For certain applications, a cutting insert having a wear resistant coating comprising hafnium carbon nitride and a binder comprising ruthenium may provide a greater service life. The wear resistant coating comprising hafnium carbon nitride may have a thickness of from 1 to 10 microns. In another embodiment, the cutting tool comprises a cemented carbide substrate with a binder comprising at least one of iron, nickel and cobalt.

46 Claims, 5 Drawing Sheets

(56) References Cited

U.S. PATENT DOCUMENTS 4,017,480 A 4/1977 Baum
4,097,275 A 6/1978 Horvath
4,106,382 A 8/1978 Salje et al.
4,126,652 A 11/1978 Oohara et al.
4,170,499 A 10/1979 Thomas et al.
4,268,569 A 5/1981 Hale
4,270,952 A 6/1981 Kobayashi
4,277,106 A 7/1981 Sahley
4,308,059 A 12/1981 Rymas
4,311,490 A 1/1982 Bovenkerk et al.
4,325,994 A 4/1982 Kitashima et al.
4,327,156 A 4/1982 Dillon et al.
4,340,327 A 7/1982 Martins
4,389,952 A 6/1983 Dreier et al.
4,432,794 A 2/1984 Holleck
4,478,297 A 10/1984 Radtke
4,550,532 A 11/1985 Fletcher, Jr. et al.
4,553,615 A 11/1985 Grainger
4,574,011 A 3/1986 Bonjour et al.
4,587,174 A 5/1986 Yoshimura et al.
4,592,685 A 6/1986 Beere
4,604,106 A 8/1986 Hall
4,605,343 A 8/1986 Hibbs, Jr. et al.
4,609,577 A 9/1986 Long
4,610,931 A 9/1986 Nemeth et al.
4,642,003 A 2/1987 Yoshimura
4,649,086 A 3/1987 Johnson
4,686,156 A 8/1987 Baldoni, II et al.
4,722,405 A 2/1988 Langford
4,729,789 A 3/1988 Ide et al.
4,734,339 A 3/1988 Schachner et al.
4,743,515 A 5/1988 Fischer et al.
4,749,053 A 6/1988 Hollingshead
4,861,350 A 8/1989 Phaal et al.
4,923,512 A 5/1990 Timm et al.
4,956,012 A 9/1990 Jacobs et al.
5,041,261 A 8/1991 Buljan et al.
RE33,753 E 11/1991 Vacchiano et al.
5,067,860 A 11/1991 Kobayashi et al.
5,098,232 A 3/1992 Benson
5,110,687 A 5/1992 Abe et al.
5,135,801 A * 8/1992 Nystrom et al. ..... 428/698
5,174,700 A 12/1992 Sgarbi et al.
5,179,772 A 1/1993 Braun et al.
5,186,739 A 2/1993 Isobe et al.
5,203,513 A 4/1993 Keller et al.
5,203,932 A 4/1993 Kato et al.
5,250,367 A 10/1993 Santhanam et al.
5,266,415 A 11/1993 Newkirk et al.
5,273,380 A 12/1993 Musacchia
5,281,260 A 1/1994 Kumar et al.
5,305,840 A 4/1994 Liang et al.
5,326,196 A 7/1994 Noll
5,333,520 A 8/1994 Fischer et al.
5,348,806 A 9/1994 Kojo et al.
5,359,772 A 11/1994 Carlsson et al.
5,376,329 A 12/1994 Morgan et al.
5,423,899 A 6/1995 Krall et al.
5,438,858 A 8/1995 Friedrichs
5,441,693 A 8/1995 Ederyd et al.
5,462,013 A 10/1995 Punola et al.
5,467,669 A 11/1995 Stroud
5,476,531 A 12/1995 Timm et al.
5,482,670 A 1/1996 Hong
5,484,468 A 1/1996 Östlund et al.
5,505,748 A 4/1996 Tank et al.
5,525,134 A 6/1996 Mehrotra et al.
5,541,006 A 7/1996 Conley
5,543,235 A 8/1996 Mirchandani et al.
5,570,978 A 11/1996 Rees et al.
5,580,666 A 12/1996 Dubensky et al.
5,590,729 A 1/1997 Cooley et al.
5,593,474 A 1/1997 Keshavan et al.
5,603,075 A 2/1997 Stoll et al.
5,609,447 A 3/1997 Britzke et al.
5,612,264 A 3/1997 Nilsson et al.
5,628,837 A 5/1997 Britzke et al.
RE35,538 E 6/1997 Akesson et al.
5,635,247 A 6/1997 Ruppi
5,658,678 A 8/1997 Stoll et al.
5,665,431 A 9/1997 Narasimhan
5,677,042 A 10/1997 Massa et al.
5,679,445 A 10/1997 Massa et al.
5,686,119 A 11/1997 McNaughton, Jr.
5,697,042 A 12/1997 Massa et al.
5,718,948 A 2/1998 Ederyd et al.
5,733,649 A 3/1998 Kelley et al.
5,733,664 A 3/1998 Kelley et al.
5,750,247 A 5/1998 Bryant et al.
5,755,033 A 5/1998 Gunter et al.
5,762,843 A 6/1998 Massa et al.
5,776,593 A 7/1998 Massa et al.
5,778,301 A 7/1998 Hong
5,789,686 A 8/1998 Massa et al.
5,792,403 A 8/1998 Massa et al.
5,802,955 A 9/1998 Stoll et al.
5,806,934 A 9/1998 Massa et al.
5,830,256 A 11/1998 Northrop et al.
5,856,626 A 1/1999 Fischer et al.
5,863,640 A 1/1999 Ljungberg et al.
5,880,382 A 3/1999 Fang et al.
5,935,351 A 8/1999 Sherman et al.
5,948,541 A 9/1999 Inspektor
5,967,249 A 10/1999 Butcher
5,976,707 A 11/1999 Grab et al.
6,007,909 A 12/1999 Rolander et al.
6,022,175 A 2/2000 Heinrich et al.
6,086,003 A 7/2000 Gunter et al.
6,089,123 A 7/2000 Chow et al.
6,209,420 B1 4/2001 Butcher et al.
6,214,247 B1 4/2001 Leverenz et al.
6,214,287 B1 4/2001 Waldenström
6,217,992 B1 4/2001 Grab
6,220,117 B1 4/2001 Butcher
6,228,139 B1 5/2001 Oskarsson
6,254,658 B1 7/2001 Taniuchi et al.
6,287,360 B1 9/2001 Kembaiyan et al.
6,290,438 B1 9/2001 Papajewski
6,293,986 B1 9/2001 Rödiger et al.
6,299,658 B1 10/2001 Moriguchi et al.
6,350,510 B1 * 2/2002 Konig et al. ..... 428/697
6,352,627 B2 3/2002 Leyendecker et al.
6,353,771 B1 3/2002 Southland
6,372,346 B1 4/2002 Toth
6,374,932 B1 4/2002 Brady
6,395,108 B2 5/2002 Eberle et al.
6,425,716 B1 7/2002 Cook
6,447,890 B1 9/2002 Leverenz et al.
6,450,739 B1 9/2002 Puide et al.
6,502,623 B1 1/2003 Schmitt
6,511,265 B1 1/2003 Mirchandani et al.
6,514,456 B1 * 2/2003 Lackner et al. ..... 420/431
6,521,172 B2 2/2003 Grearson et al.
6,544,308 B2 4/2003 Griffin et al.
6,554,548 B1 4/2003 Grab et al.
6,562,462 B2 5/2003 Griffin et al.
6,585,064 B2 7/2003 Griffin et al.
6,617,058 B2 9/2003 Schier
6,620,375 B1 9/2003 Tank et al.
6,638,609 B2 10/2003 Nordgren et al.
6,655,882 B2 12/2003 Heinrich et al.
6,660,371 B1 * 12/2003 Westphal et al. ..... 428/336
6,676,863 B2 1/2004 Christiaens et al.
6,685,880 B2 2/2004 Engström et al.
6,719,074 B2 4/2004 Tsuda et al.
6,723,389 B2 4/2004 Kobayashi et al.
6,737,178 B2 5/2004 Ota et al.
6,764,555 B2 7/2004 Hiramatsu et al.
6,827,975 B2 12/2004 Leverenz et al.
6,830,604 B2 12/2004 Grearson et al.
6,844,085 B2 1/2005 Takayama et al.
6,848,521 B2 2/2005 Lockstedt et al.
6,869,334 B1 3/2005 Leyendecker et al.
6,884,496 B2 4/2005 Westphal et al.

| | | | |
|---|---|---|---|
| 6,884,497 | B2 | 4/2005 | Sulin et al. |
| 6,892,793 | B2 | 5/2005 | Liu et al. |
| 6,911,063 | B2 | 6/2005 | Liu |
| 6,929,851 | B1 | 8/2005 | Leverenz et al. |
| 6,949,148 | B2 | 9/2005 | Sugiyama et al. |
| 6,955,233 | B2 | 10/2005 | Crowe et al. |
| 6,958,099 | B2 | 10/2005 | Nakamura et al. |
| 7,014,719 | B2 | 3/2006 | Suzuki et al. |
| 7,014,720 | B2 | 3/2006 | Iseda |
| 7,070,666 | B2 | 7/2006 | Druschitz et al. |
| 7,090,731 | B2 | 8/2006 | Kashima et al. |
| 7,101,446 | B2 | 9/2006 | Takeda et al. |
| 7,125,207 | B2 * | 10/2006 | Craig et al. |
| 7,128,773 | B2 | 10/2006 | Liang et al. |
| 7,175,404 | B2 | 2/2007 | Kondo et al. |
| 7,207,750 | B2 | 4/2007 | Annanolli et al. |
| 7,238,414 | B2 | 7/2007 | Benitsch et al. |
| 7,244,519 | B2 | 7/2007 | Festeau et al. |
| 7,250,069 | B2 | 7/2007 | Kembaiyan et al. |
| 7,267,543 | B2 | 9/2007 | Freidhoff et al. |
| 7,381,283 | B2 | 6/2008 | Lee et al. |
| 7,384,413 | B2 | 6/2008 | Gross et al. |
| 7,384,443 | B2 | 6/2008 | Mirchandani et al. |
| 7,410,610 | B2 | 8/2008 | Woodfield et al. |
| 7,497,396 | B2 | 3/2009 | Splinter et al. |
| 7,513,320 | B2 | 4/2009 | Mirchandani et al. |
| 7,625,157 | B2 | 12/2009 | Prichard et al. |
| 7,687,156 | B2 | 3/2010 | Fang |
| 7,691,496 | B2 | 4/2010 | Park et al. |
| 7,846,551 | B2 | 12/2010 | Fang et al. |
| 8,007,922 | B2 | 8/2011 | Mirchandani et al. |
| 8,025,112 | B2 | 9/2011 | Mirchandani et al. |
| 2003/0010409 | A1 | 1/2003 | Kunze et al. |
| 2003/0041922 | A1 | 3/2003 | Hirose et al. |
| 2003/0161695 | A1 * | 8/2003 | Grab et al. ..... 407/119 |
| 2003/0219605 | A1 | 11/2003 | Molian et al. |
| 2004/0105730 | A1 | 6/2004 | Nakajima |
| 2004/0234820 | A1 | 11/2004 | Majagi |
| 2005/0103404 | A1 | 5/2005 | Hsieh et al. |
| 2005/0194073 | A1 | 9/2005 | Hamano et al. |
| 2005/0211475 | A1 | 9/2005 | Mirchandani et al. |
| 2005/0247491 | A1 | 11/2005 | Mirchandani et al. |
| 2006/0060392 | A1 | 3/2006 | Eyre |
| 2006/0286410 | A1 | 12/2006 | Ahigren et al. |
| 2007/0082229 | A1 | 4/2007 | Mirchandani et al. |
| 2007/0126334 | A1 | 6/2007 | Nakamura et al. |
| 2007/0163679 | A1 | 7/2007 | Fujisawa et al. |
| 2007/0193782 | A1 | 8/2007 | Fang et al. |
| 2008/0011519 | A1 | 1/2008 | Smith et al. |
| 2008/0101977 | A1 | 5/2008 | Eason et al. |
| 2008/0163723 | A1 | 7/2008 | Mirchandani et al. |
| 2008/0302576 | A1 | 12/2008 | Mirchandani et al. |
| 2009/0041612 | A1 | 2/2009 | Fang et al. |
| 2009/0136308 | A1 | 5/2009 | Newitt |
| 2009/0180915 | A1 | 7/2009 | Mirchandani et al. |
| 2009/0293672 | A1 | 12/2009 | Mirchandani et al. |
| 2010/0044114 | A1 | 2/2010 | Mirchandani et al. |
| 2010/0044115 | A1 | 2/2010 | Mirchandani et al. |
| 2010/0290849 | A1 | 11/2010 | Mirchandani et al. |
| 2010/0303566 | A1 | 12/2010 | Fang et al. |
| 2011/0011965 | A1 | 1/2011 | Mirchandani et al. |
| 2011/0052931 | A1 | 3/2011 | Morton et al. |

FOREIGN PATENT DOCUMENTS

| | | | |
|---|---|---|---|
| CA | 2212197 | C | 10/2000 |
| CH | 647813 | A5 | 2/1985 |
| DE | 2719532 | A1 | 11/1977 |
| EP | 0157625 | A2 | 10/1985 |
| EP | 0264674 | A2 | 4/1988 |
| EP | 0453428 | A1 | 10/1991 |
| EP | 0995876 | A2 | 4/2000 |
| EP | 1077783 | B1 | 2/2001 |
| EP | 1106706 | A1 | 6/2001 |
| EP | 0759480 | B1 | 1/2002 |
| EP | 1686193 | A2 | 8/2006 |
| EP | 1198609 | B2 | 10/2007 |
| GB | 622041 | A | 4/1949 |
| GB | 1082568 | A | 9/1967 |
| GB | 1309634 | A | 3/1970 |
| GB | 1393115 | | 5/1975 |
| GB | 1393116 | | 5/1975 |
| GB | 1420906 | | 1/1976 |
| GB | 1491044 | | 11/1977 |
| GB | 2158744 | A | 11/1985 |
| GB | 2352727 | A | 2/2001 |
| GB | 2393449 | A | 3/2004 |
| GB | 2435476 | A | 8/2007 |
| JP | 59-175912 | A | 10/1984 |
| JP | 61-243103 | A | 10/1986 |
| JP | 61-261453 | A | 11/1986 |
| JP | 61-261455 | A | 11/1986 |
| JP | 62-063005 | A | 3/1987 |
| JP | 02254144 | | 10/1990 |
| JP | 2-269515 | A | 11/1990 |
| JP | 5-50314 | A | 3/1993 |
| JP | H03-119090 | U | 6/1995 |
| JP | H07-276105 | A | 10/1995 |
| JP | 8-120308 | A | 5/1996 |
| JP | H8-209284 | | 8/1996 |
| JP | H09-011005 | A | 1/1997 |
| JP | 10219385 | A | 8/1998 |
| JP | H11-010409 | A | 1/1999 |
| JP | 11-300516 | A | 11/1999 |
| JP | 2002-097885 | A | 4/2002 |
| JP | 2002-166326 | A | 6/2002 |
| JP | 2002-317596 | A | 10/2002 |
| JP | 2003-306739 | | 10/2003 |
| JP | 2004-181604 | | 7/2004 |
| JP | 2004-190034 | A | 7/2004 |
| JP | 2005-111581 | A | 4/2005 |
| RU | 2135328 | C1 | 8/1999 |
| RU | 2173241 | C2 | 2/2000 |
| RU | 2200209 | C2 | 3/2003 |
| SU | 1050810 | A1 | 10/1983 |
| SU | 1292917 | A1 | 2/1987 |
| SU | 1350322 | | 11/1987 |
| WO | WO 92/05009 | A1 | 4/1992 |
| WO | WO 99/13121 | A | 3/1999 |
| WO | WO 00/52217 | A | 9/2000 |
| WO | WO 00/73532 | A1 | 12/2000 |
| WO | WO 03/010350 | A1 | 2/2003 |
| WO | WO 2005/045082 | | 5/2005 |
| WO | WO 2005/054530 | A1 | 6/2005 |
| WO | WO 2005/061746 | A1 | 7/2005 |
| WO | WO 2006/023222 | A | 3/2006 |
| WO | WO 2006/071192 | A1 | 7/2006 |
| WO | WO 2006/104004 | | 10/2006 |
| WO | WO 2007/001870 | A2 | 1/2007 |
| WO | WO 2007/022336 | A2 | 2/2007 |
| WO | WO 2007/030707 | A1 | 3/2007 |
| WO | WO 2007/044791 | A1 | 4/2007 |
| WO | WO 2007/127680 | A1 | 11/2007 |
| WO | WO 2008/098636 | A1 | 8/2008 |
| WO | WO 2008/103605 | | 8/2008 |
| WO | WO 2008/115703 | A1 | 9/2008 |
| WO | WO 2011/008439 | A2 | 1/2011 |

OTHER PUBLICATIONS

Coyle, T.W. and A. Bahrami, "Structure and Adhesion of Ni and Ni-WC Plasma Spray Coatings," Thermal Spray, Surface Engineering via Applied Research, Proceedings of the 1st International Thermal Spray Conference, May 8-11, 2000, Montreal, Quebec, Canada, 2000, pp. 251-254.

Deng, X. et al., "Mechanical Properties of a Hybrid Cemented Carbide Composite," International Journal of Refractory Metals and Hard Materials, Elsevier Science Ltd., vol. 19, 2001, pp. 547-552.

Gurland, Joseph, "Application of Quantitative Microscopy to Cemented Carbides," Practical Applications of Quantitative Matellography, ASTM Special Technical Publication 839, ASTM 1984, pp. 65-84.

Hayden, Matthew and Lyndon Scott Stephens, "Experimental Results for a Heat-Sink Mechanical Seal," Tribology Transactions, 48, 2005, pp. 352-361.

Peterman, Walter, "Heat-Sink Compound Protects the Unprotected," Welding Design and Fabrication, Sep. 2003, pp. 20-22.

Shi et al., "Composite Ductility—The Role of Reinforcement and Matrix", TMS Meeting, Las Vegas, NV, Feb. 12-16, 1995, 10 pages.
Sriram, et al., "Effect of Cerium Addition on Microstructures of Carbon-Alloyed Iron Aluminides," Bull. Mater. Sci., vol. 28, No. 6, Oct. 2005, pp. 547-554.
Underwood, *Quantitative Stereology*, pp. 23-108 (1970).
Vander Vort, "Introduction to Quantitative Metallography", Tech Notes, vol. 1, Issue 5, published by Buehler, Ltd. 1997, 6 pages.
J. Gurland, *Quantitative Microscopy*, R.T. DeHoff and F.N. Rhines, eds., McGraw-Hill Book Company, New York, 1968, pp. 279-290.
You Tube, "The Story Behind Kennametal's Beyond Blast", dated Sep. 14, 2010, http://www.youtube.com/watch?v=8_A-bYVwmU8 (3 pages) accessed on Oct. 14, 2010.
Kennametal press release on Jun. 10, 2010, http://news.thomasnet.com/companystory/Kennametal-Launches-Beyond-BLAST-TM-at-IMTS-2010-Booth-W-1522-833445 (2 pages) accessed on Oct. 14, 2010.
Pages from Kennametal site, https://www.kennametal.com/en-US/promotions/Beyond_Blast.jhtml (7 pages) accessed on Oct. 14, 2010.
ASM Materials Engineering Dictionary, J.R. Davis, Ed., ASM International, Fifth printing, Jan. 2006, p. 98.
Childs et al., "Metal Machining", 2000, Elsevier, p. 111.
Brookes, Kenneth J. A., "World Directory and Handbook of Hardmetals and Hard Materials", International Carbide Data, U.K. 1996, Sixth Edition, p. 42.
Firth Sterling grade chart, Allegheny Technologies, attached to Declaration of Prakash Mirchandani, Ph.D., U.S. Appl. No. 11/737,993, filed Sep. 9, 2009.
Metals Handbook Desk Edition, definition of 'wear', 2nd Ed., J.R. Davis, Editor, ASM International 1998, p. 62.
McGraw-Hill Dictionary of Scientific and Technical Terms, 5th Edition, Sybil P. Parker, Editor in Chief, 1993, pp. 799, 800, 1933, and 2047.
ProKon Version 8.6, the Calculation Companion, Properties for W, Ti, Mo, Co, Ni and FE, Copyright 1997-1998, 6 pages.
TIBTECH Innovations, "Properties table of stainless steel, metals and other conductive materials", printed from http://www.tibtech.com/conductivity.php on Aug. 19, 2011, 1 page.
"Material: Tungsten Carbide (WC), bulk", MEMSnet, printed from http://www.memsnet.org/material/tungstencarbidewcbulk/ on Aug. 19, 2001, 1 page.
Williams, Wendell S., "The Thermal Conductivity of Metallic Ceramics", JOM, Jun. 1998, pp. 62-66.
Brookes, Kenneth J. A., "World Directory and Handbook of Hardmetals and Hard Materials", International Carbide Data, U.K. 1996, Sixth Edition, pp. D182-D184.
Thermal Conductivity of Metals, the Engineering ToolBox, printed from http://www.engineeringtoolbox.com/thermal-conductivity-metals-d_858.html on Oct. 27, 2011, 3 pages.
Shing et al., "The effect of ruthenium additions on hardness, toughness and grain size of WC-Co," Int. J. of Refractory Metals & Hard Materials, vol. 19, pp. 41-44, 2001.
Biernat, "Coating can greatly enhance carbide tool life and performance, but only if they stay in place," Cutting Tool Engineering, 47(2), Mar. 1995.
Brooks, World Dictionary and Handbook of Hardmetals and Hard Materials, International Carbide Data, Sixth edition, 1996, p. D194.
Tonshoff et al., "Surface treatment of cutting tool substrates," Int. J. Tools Manufacturing, 38(5-6), 1998, 469-476.
Bouzakis et al., "Improvement of PVD Coated Inserts Cutting Performance Through Appropriate Mechanical Treatments of Substrate and Coating Surface", Surface and Coatings Technology, 2001, 146-174; pp. 443-490.
Destefani, "Cutting tools 101: Coatings," Manufacturing Engineering, 129(4), 2002, 5 pages.
Santhanam, et al., "Comparison of the Steel-Milling Performance of Carbide Inserts with MTCVD and PVD TiCN Coatings", Int. J. of Refractory Metals & Hard Materials, vol. 14, 1996, pp. 31-40.
Wolfe et al., "The Role of Hard Coating in Carbide Milling Tools", J. Vacuum Science Technology, vol. 4, No. 6, Nov/Dec 1986, pp. 2747-2754.
Quinto, "Mechanical Property and Structure Relationships in Hard Coatings for Cutting Tools", J. Vacuum Science Technology, vol. 6, No. 3, May/Jun. 1988, pp. 2149-2157.
U.S. Appl. No. 13/286,355, filed Nov. 1, 2011.
"Production Know-How," Metalworking Production, Feb. 1985, p. 40.
"Ruthenium Boosts Carbide's Capability," Metalworking Production, Jun. 1978, p. 13.
"Ruthenium-Containing Carbide Tips Extend the Life of Cutting Tools," Inco Europe Limited, London, May 1978.
Bonjour, Christian, "Effects of Ruthenium Additions on the Propoerties and Machining Behaviour of WC-Co Hard Metals," Uni. of App. Sciences of West. Switz., Euro PM2004.
Bonjour, C., "Nouveaux Developpements Dans Les Outils De Coupe en Carbure Fritte," Wear, 62,(1980) pp. 83-122, the Netherlands.
Brookes, Ken, "Functional Design Puts the Bite into Hard and Refractory Metals," metal-powder.net, Nov. 2003, pp. 20-25.
Brookes, Ken, "Higher Speed Metals—Alias Carbides," MPR, Aug. 1982, pp. 411, 412, 414.
Brookes, Ken, "Phase Inhibition and Residual Stresses," metal-powder.net, Mar. 2003, pp. 22-23.
Brookes, Ken, "Ruthenium Exploits its Precious Talent," Metalworking Production, Jul. 1979, pp. 77, 78, 80.
Brookes, Ken, "Stellram Continues Hardmetal Development," MPR, Nov. 1994, pp. 28-31.
Jackson, J.S., et al., "Cemented Carbides with High Melting-Point Precious-Metal Binder Phases," Powder Metallurgy Limited, 1974, pp. 255-269.
Lisovskii, A.F., "Cemented Carbides Alloyed with Ruthenium, Osmium, and Rhenium," Powder Metallurgy and Metal Ceramics, vol. 39, Nos. 9-10, 2000, pp. 428-433.
Lisovsky, A.F., "Some Problems on Technical Use of the Phenomenon of Metal Melts Imbibition of Sintered Composites," Powder Metallurgy Intl, vol. 21, No. 6, 1989, pp. 7-9.
Lisovsky, A.F. et al., "On the Use of the Mmi-Phenomenon for the Formation of Nanostructures in WC-Co Cemented Carbides," Int. J. Of Refractory Metals & Hard Materials 15(1997) 227-235, Great Britain.
Luyckx, S., "High Temperature Hardness of WC-Co-Ru," Journal of Materials Science Letters 21, 2002, 1681-1682.
Panteleev, I.B., "Oxidation Resistance and High-Temperature Strength of Wc-Co-Ni-Re (Mn) Hard Alloys," Powder Metallurgy and Metal Ceramics, vol. 45, Nos. 7-8, 2006, 342-345.
Penrice, T.W., "Alternative Binders for Hard Metals," Carbide and Tool Journal, Jul./Aug., pp. 12-15.
Penrice, T.W., "Some Characteristics of the Binder Phase in Cemented Carbides," Int. J. Of Refractory Metals & Hard Materials 15(1997) 113-121.
"Ruthenium and Refractory Carbides—Titanium Carbide Composites of Remarkable Stability," Platinum Metals Rev., 1974, 18(1), 27-28.
"Ruthenium as a Binder for Cemented Carbides," Platinum Metals Rev., 1974, 18, (4), p. 129.
"Stellram to Produce Ruthenium-Containing Hardmetal," p. 435.
Warren, R., et al., "The Microstructure sn Properties of Sintereed TiC-Ruthenium Alloys," Powder Metallurgy International, vol. 7, No. 1, 1975, pp. 18-21.
Grade X500 description, printed from www.stellram.com via http://www.archive.org/web/web.php dated Aug. 19, 2007 on Feb. 10, 2012, 1 page.
Pastor, H., "Present Status and Development of Tool Materials: Part 1 Cutting Tools", International Journal of Refractory Metals and Hard Materials (R&HM), Dec. 1987, pp. 196-209.
Shing et al., "The effect of ruthenium additions on hardness, toughness and grain size of WC-Co," Euro PM99, Properties, pp. 245-252.
Schmid et al., "The Mechanical Behaviour of Cemented Carbides at High Temperatures", Materials Science and Engineering, A105/106, 1988, pp. 343-351.
Brookes, World Dictionary and Handbook of Hardmetals and Hard Materials, International Carbide Data, Sixth edition, 1996, p. D194.

Bouzakis et al., "Increasing of cutting performance of PVD coated cemented carbide inserts in chipboard miling through improvement of the file adhesion, considering the coating cutting loads", Surface and Coating Technology (2000), 133-134, 548-554.

US 4,966,627, 10/1990, Keshavan et al. (withdrawn)

* cited by examiner

Thermal Cracking Test 1 (TiN-TiCN-$Al_2O_3$)
3 passes with 4 thermal cracks

Thermal Cracking Test 1 (HfN)
3 passes with 3 thermal cracks

Thermal Cracking Test 1 (HfCN)
3 passes with 1 thermal crack

Thermal Cracking Test 2 (TiN-TiCN-$Al_2O_3$)
2 passes with 12 thermal cracks

Thermal Cracking Test 2 (HfN)
1 pass with edge destroyed

Thermal Cracking Test 2 (HfCN)
2 passes with 1 thermal crack

CARBIDE CUTTING INSERT

TECHNICAL FIELD

The present invention is directed to embodiments of a cutting tool comprising a wear resistant coating on a substrate. The substrate comprises metal carbides in a binder, wherein the binder comprises ruthenium. In one embodiment, the cutting tool further comprises a wear resistant coating comprising hafnium carbon nitride. In a specific embodiment, the cutting tool comprises a hafnium carbon nitride wear resistant coating on a substrate comprising tungsten carbide (WC) in a binder comprising cobalt and ruthenium. Such embodiments may be particularly useful for machining difficult to machine materials, such as, but not limited to, titanium and titanium alloys, nickel and nickel alloys, super alloys, and other exotic materials.

BACKGROUND

A common mode of failure for cutting inserts is cracking due to thermal shock. Thermal shock is even more common in the more difficult machining processes, such as high productivity machining processes and machining of materials with a high hot hardness, for example. In order to reduce the buildup of heat in cutting inserts, coolants are used in machining operations. However, the use of coolants during the machining operation contributes to thermal cycling that may also contribute to failure of the cutting insert by thermal shock.

Thermal cycling also occurs in milling applications where the milling cutter gets hot when actually cutting the work material and then cools when not cutting the work material. Such thermal cycling of heating and cooling results in sharp temperature gradients in the cutting inserts, and the resulting in differences in expansion of different portions of the insert causing internal stresses and initiation of cracks in the cutting inserts. There is a need to develop a novel carbide cutting insert that can not only maintain efficient cutting performance during the high-hot hardness machining process, but also improve the tool life by resisting thermal cracking.

The service life of a cutting insert or cutting tool is also a function of the wear properties of the cemented carbide. One way to increase cutting tool life is to employ cutting inserts made of materials with improved combinations of strength, toughness, and abrasion/erosion resistance. Cutting inserts comprising cemented carbide substrates for such applications is predicated on the fact that cemented carbides offer very attractive combinations of strength, fracture toughness, and wear resistance (such properties that are extremely important to the efficient functioning of the boring or drilling bit). Cemented carbides are metal-matrix composites comprising carbides of one or more of the transition metals as the hard particles or dispersed phase and cobalt, nickel, or iron (or alloys of these metals) as the binder or continuous phase. Among the different possible hard particle-binder combinations, cemented carbides comprising tungsten carbide (WC) as the hard particle and cobalt as the binder phase are the most commonly used for cutting tools and inserts for machining operations.

The bulk properties of cemented carbides depend upon, among other features, two microstructural parameters, namely, the average hard particle grain size and the weight or volume fraction of the hard particles and/or the binder. In general, the hardness and wear resistance increases as the grain size decreases and/or the binder content decreases. On the other hand, fracture toughness increases as the grain size increases and/or as the binder content increases. Thus there is a trade-off between wear resistance and fracture toughness when selecting a cemented carbide grade for any application. As wear resistance increases, fracture toughness typically decreases and vice versa.

In addition, alloying agents may be added to the binder. A limited number of cemented carbide cutting tools or cutting inserts have ruthenium added to the binder. The binder may additionally comprise other alloying compounds, such as TiC and TaC/NbC, to refine the properties of the substrate for particular applications.

Ruthenium (Ru) is a member of the platinum group and is a hard, lustrous, white metal that has a melting point of approximately 2,500° C. Ruthenium does not tarnish at room temperatures, and may be used as an effective hardener, creating alloys that are extremely wear resistant. It has been found that ruthenium in a cobalt binder of a cemented carbide used in a cutting tool or cutting insert improves the resistance to thermal cracking and significantly reduces crack propagation along the edges and into the body of the cutting tool or cutting insert. Typically commercially available cutting tools and cutting inserts may include a concentration of ruthenium in the binder phase of cemented carbide substrates in the ranges of approximately 3% to 30%, by weight.

A cutting insert comprising a cemented carbide substrate may comprise a single or multiple layer coating on the surface to enhance its cutting performance. Methods for coating cemented carbide cutting tools include chemical vapor deposition (CVD), physical vapor deposition (PVD) and diamond coating. Most often, CVD is used to apply the coating to cutting inserts due to the well-known advantages of CVD coatings in cutting tools.

An example of PVD coating technologies, Leyendecker et al. discloses, in a U.S. Pat. No. 6,352,627, a PVD coating method and device, which is based on magnetron sputter-coating techniques to produce refractory thin films or coats on cutting inserts, can deliver three consecutive voltage supplies during the coating operation, promoting an optimally enhanced tonization process that results in good coating adhesion on the substrate, even if the substrate surface provided is rough, for example because the surface was sintered, ground or jet abrasion treated.

An example of CVD coating technologies, Punola et al. discloses, in a U.S. Pat. No. 5,462,013, a CVD coating apparatus that uses a unique technique to control the reactivity of a gaseous reactant stream at different coating zones in the CVD reactor. As a result, the CVD coating produced has greatly improved uniformity in both composition and thickness.

An example of hard-metal coating developments and applications in cutting inserts with regular carbide substrates, Leverenz and Bost from Stellram, an Allegheny Technologies Company located at One Teledyne Place, LaVergne, Tenn., USA 37086 and also the assignee of this invention, describes in a recently granted U.S. Pat. No. 6,929,851, a surface etching technology that is used to enhance the CVD or PVD coating including HfCN coating on the regular carbide substrates. Additional examples of hard-metal coating developments and applications in cutting inserts with regular carbide substrates are U.S. Pat. No. 4,268,569 by Hale in 1981, U.S. Pat. No. 6,447,890 by Leverenz et al. in 2002, U.S. Pat. No. 6,617,058 by Schier in 2003, U.S. Pat. No. 6,827,975 by Leverenz et al. in 2004 and U.S. Pat. No. 6,884,496 by Westphal and Scottke in 2005.

SUMMARY

The invention is directed to cutting tools and cutting inserts comprising a substrate comprising metal carbide particles and a binder and at least one wear resistant coating on the substrate. In one embodiment the wear resistant coating comprises hafnium carbon nitride and the binder comprises ruthenium. In another embodiment, the wear resistant coating consists essentially of hafnium carbon nitride. The cutting tools of the invention may comprise a single wear resistant coating or multiple wear resistant coatings. The wear resistant coating comprising hafnium carbon nitride may have a thickness of from 1 to 10 microns. In embodiments, the cutting tool comprises a cemented carbide substrate with a binder comprising at least one of iron, nickel and cobalt.

As used in this specification and the appended claims, the singular forms "a" and "the" include plural referents unless the context clearly dictates otherwise. Thus, for example, reference to "a wear resistant coating" may include more than one coating or a multiple coating.

Unless otherwise indicated, all numbers expressing quantities of ingredients, time, temperatures, and so forth used in the present specification and claims are to be understood as being modified in all instances by the term "about." Accordingly, unless indicated to the contrary, the numerical parameters set forth in the following specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, may inherently contain certain errors necessarily resulting from the standard deviation found in their respective testing measurements.

It is to be understood that this invention is not limited to specific compositions, components or process steps disclosed herein, as such may vary. It is also to be understood that the terminology used herein is for the purpose of describing particular embodiments only, and is not intended to be limiting.

DESCRIPTION OF THE INVENTION

Figure 1:
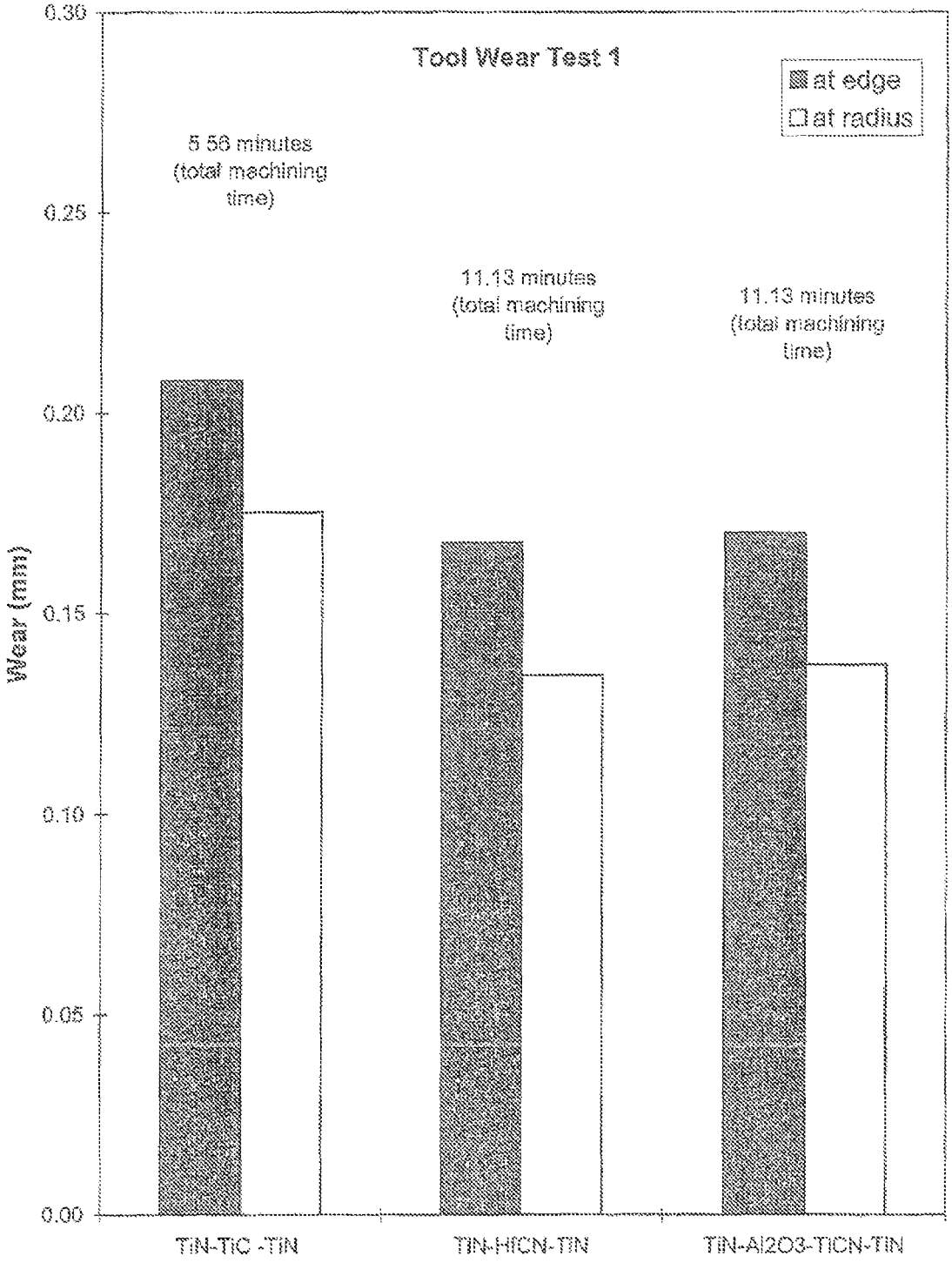
FIG. 1 is a bar graph comparing the experimental results of Tool Wear Test 1 for three cutting inserts with different coatings machining Inconel 718.

Embodiments of the invention include cutting tools and cutting inserts comprising substrates comprising cemented carbides. The binders of cemented carbides comprise at least one of iron, nickel, and cobalt, and in embodiments of the present invention the binder additionally comprises ruthenium. Ruthenium may be present in any quantity effective to have a beneficial effect on the properties of the cutting tool, such as a concentration of ruthenium in the binder from 1% to 30%, by weight. In certain embodiments, the concentration of ruthenium in the binder may be from 3% to 30%, by weight, from 8% to 20%, or even from 10% to 15%, by weight.

The invention is based on a unique discovery that applying a specific hard metal coating comprising hafnium carbon nitride (HfCN) to a cutting tool or cutting insert comprising a cemented carbide comprising ruthenium in the binder phase can reduce the initiation and propagation of thermal cracks during metal machining. The hafnium carbon nitride coating may be a single coating on the substrate or one coating of multiple coatings on the substrate, such as a first coating, an intermediate coating, or a final coating. Embodiments of cutting tools comprising the additional coating may include coatings applied by either PVD or CVD and may include coating comprising at least one of a metal carbide, a metal nitride, a metal boride, and a metal oxide of a metal selected from groups IIIA, IVB, VB, and VIB of the periodic table. For example, a coating on the cutting tools and cutting inserts of the present invention include hafnium carbon nitride and, for example, may also comprise at least one coating of titanium nitride (TiN), titanium carbonitride (TiCN), titanium carbide (TiC), titanium aluminum nitride (TiAlN), titanium aluminum nitride plus carbon (TiAlN+C), aluminum titanium nitride (AlTiN), aluminum titanium nitride plus carbon (AlTiN+C), titanium aluminum nitride plus tungsten carbide/carbon (TiAlN+WC/C), aluminum titanium nitride (AlTiN), aluminum titanium nitride plus carbon (AlTiN+C), aluminum titanium nitride plus tungsten carbide/carbon (AlTiN+WC/C), aluminum oxide ($Al_2O_3$), α-alumina oxide, titanium diboride ($TiB_2$), tungsten carbide carbon (WC/C), chromium nitride (CrN), aluminum chromium nitride (AlCrN), hafnium carbon nitride (HfCN), alone or in any combinations. In certain embodiments, any coating may be from 1 to 10 micrometers thick; though it may be preferable in specific applications for the hafnium carbon nitride coating to be from 2 to 6 micrometers thick.

In certain embodiments of the cutting insert of the invention, coatings comprising at least one of zirconium nitride (ZrN), zirconium carbon nitride (ZrCN), boron nitride (BN), or boron carbon nitride (BCN) may be used in combination with the hafnium carbon nitride coating or replacing the hafnium carbon nitride coating. In certain other embodiments, the cutting insert may comprise a wear resistant coating consisting essentially of a coating selected from zirconium nitride (ZrN), zirconium carbon nitride (ZrCN), boron nitride (BN), or boron carbon nitride (BCN).

The coating comprising hafnium carbon nitride, the coating consisting essentially of hafnium carbon nitride, or the coating comprising zirconium nitride, zirconium carbon nitride, boron nitride, or boron carbon nitride coating applied to the cutting tool or cutting insert of the present invention produce coatings with enhanced hardness, reduced friction, chemical stability, wear resistance, thermal crack resistance and prolonged tool life.

The present invention also includes methods of coating a substrate. Embodiments of the method of the present invention include applying the coatings described above on a cemented carbide substrate by either CVD or PVD, wherein the cemented carbide substrate comprises hard particles and a binder and the binder comprises ruthenium. The method may include treating the substrate prior to coating the substrate. The treating prior to coating comprises at least one of electropolishing, shot peening, microblasting, wet blasting, grinding, brushing, jet abrading and compressed air blasting. Pre-coating surface treatments on any coated (CVD or PVD) carbide cutting inserts may reduce the cobalt capping effect of substrates. Examples of pre-coating surface treatments include wet blasting (U.S. Pat. Nos. 5,635,247 and 5,863,640), grinding (U.S. Pat. No. 6,217,992 B1), electropolishing (U.S. Pat. No. 5,665,431), brushing (U.S. Pat. No. 5,863,640), etc. Improper pre-coating surface treatment may lead to poor adhesion of a CVD or PVD coating on the substrate comprising ruthenium in the binder, thus resulting in premature failure of CVD or PVD coatings. This is primarily due to the fact that the CVD and PVD coating layers are thin and the surface irregularities due to cobalt capping are more pronounced in a carbide substrate comprising ruthenium.

Embodiments of the method may comprise optional post-coating surface treatments of coated carbide cutting inserts may further improve the surface quality of wear resistant coating. There are a number of methods for post-coating surface treatments, for example, shot peening, Japanese Patent No. 02254144, incorporated by reference, which is based on the speed injection of small metal particles having a spherical grain shape with grain size in a range of 10-2000 μm. Another example of post-coating surface treatment is compressed-air blasting, European Patent No. 1,198,609 B1, incorporated by reference, which uses an inorganic blasting agent, like $Al_2O_3$, with a very fine grain size ranging from 1 to 100 μm. Another example of post coating treatment is brushing, U.S. Pat. No. 6,638,609 B2, incorporated by reference, which uses a nylon straw brush containing SiC grains. A gentle wet blasting can also be used as a post-coating surface treatment to create a smooth coating layer, U.S. Pat. No. 6,638,609 B2, incorporated by reference. In general, a surface treatment, such as, but not limited to, blasting, shot peening, compressed air blasting, or brushing, on coated inserts comprising ruthenium in the binder can improve the properties of the surface of the coatings.

In embodiments of both the method and the cutting inserts, the cemented carbide in the substrate may comprise metal carbides of one or more elements belonging to groups IVB through VIB of the periodic table. Preferably, the cemented carbides comprise at least one transition metal carbide selected from titanium carbide, chromium carbide, vanadium carbide, zirconium carbide, hafnium carbide, tantalum carbide, molybdenum carbide, niobium carbide, and tungsten carbide. The carbide particles preferably comprise about 60 to about 98 weight percent of the total weight of the cemented carbide material in each region. The carbide particles are embedded within a matrix of a binder that preferably constitutes about 2 to about 40 weight percent of the total weight of the cemented carbide.

The binder of the cemented carbide comprises ruthenium and at least one of cobalt, nickel, iron. The binder also may comprise, for example, elements such as tungsten, chromium, titanium, tantalum, vanadium, molybdenum, niobium, zirconium, hafnium, and carbon up to the solubility limits of these elements in the binder. Additionally, the binder may contain up to 5 weight percent of elements such as copper, manganese, silver, and aluminum. One skilled in the art will recognize that any or all of the constituents of the cemented hard particle material may be introduced in elemental form, as compounds, and/or as master alloys.

EXAMPLES

The following examples are given to further describe some details of this invention regarding the performance tests of cutting inserts comprising a substrate comprising ruthenium in the binder with CVD coatings.

Example 1

Results of Wear Test (GX20 Substrate)

Stellram's GX20™, a trademark of Allegheny Technologies, Inc. is a cemented carbide powder comprising ruthenium. GX20™ may be used to prepare a tough grade of cemented carbide for use in machining P45/K35 materials according to ISO standard. The nominal chemical composition and properties of the substrate of Stellram's GX20™ cutting inserts is shown in Table 1. The major constituents in GX20™ metal powders include tungsten carbide, cobalt and ruthenium.

TABLE 1

Properties of the GX20 ™ Substrate

| Chemical Compositions (weight percent) | | | Average Grain Size | Transverse Rupture Strength | Density | Hardness |
|---|---|---|---|---|---|---|
| WC | Co | Ru | (μm) | ($N/mm^2$) | ($g/cm^3$) | (HRA) |
| 89.1 | 9.5 | 1.4 | 2.5 | 3500 | 14.55 | 89.5 |

The metal powders in Table 1 were mixed and then wet blended by a ball mill over a 72-hour period. After drying, the blended compositions were compressed into compacted green bodies of the designed cutting insert under a pressure of 1-2 tons/$cm^2$. The compacted green bodies of the tungsten carbide cutting inserts were sintered in a furnace to close the pores in the green bodies and build up the bond between the hard particles to increase the strength and hardness.

In particular, to effectively reduce the micro-porosity of the sintered substrate and ensure the consistent sintering quality of GX20™ carbide cutting inserts, the sinter-HIP, i.e. high-pressure sintering process, was used to introduce a pressure phase following the dewaxing, presintering and low-pressure nitrogen ($N_2$) sintering cycle. The sintering procedure for GX20™ carbide cutting inserts was performed with the following major sequential steps:

- a dewaxing cycle starts at room temperature with a ramping speed of 2° C./min until reaching 400° C. and then holds for approximate 90 minutes;
- a presintering cycle, which breaks down the oxides of Co, WO, Ti, Ta, Nb, etc., starts with a ramping speed of 4° C./min until reaching 1,200° C. and then holds at this temperature for 60 minutes;
- a low pressure nitrogen ($N_2$) cycle is then introduced at 1,350° C. during the temperature ramping from 1,200° C. to 1,400° C./1,450° C., i.e. sintering temperature, and then holds at this sintering temperature at a low nitrogen pressure of about 2 torrs for approximate 30 minutes;
- a sinter-HIP process is then initiated while at the sintering temperature, i.e. 1,400/1450° C., during the process argon (Ar) pressure is introduced and rises to 760 psi in 30 minutes, and then the sinter-HIP process holds at this pressure for additional 30 minutes; and finally
- a cooling cycle is carried out to let the heated green bodies of the GX20 carbide cutting inserts cool down to room temperature while inside the furnace.

Thus obtained GX20™ carbide cutting inserts shrunk into the desired sintered size and became non-porous. Followed by the sintering process, the sintered tungsten carbide cutting inserts may be ground and edge-honed.

Then three different CVD multilayer coatings were applied to the GX20 substrates, as shown in Table 2 for details.

TABLE 2

| CVD Coatings | | |
|---|---|---|
| Multilayer Coatings | Individual Coating | Chemical Reactions |
| TiN—TiC—TiN | First Coating: TiN | $H_2 + N_2$ + Titanium Tetrachloride ($TiCl_4$) |
| | Second Coating: TiC | $H_2 + TiCl_4 + CH_4$ |
| | Third Coating: TiN | $H_2 + N_2$ + Titanium Tetrachloride ($TiCl_4$) |
| TiN—HfCN—TiN | First Coating: TiN | $H_2 + N_2$ + Titanium Tetrachloride ($TiCl_4$) |
| | Second Coating: HfCN | $H_2 + N_2$ + Hafnium Tetrachloride ($HfCl_4$) + Acetonitrile ($CH_3CN$) |
| | Third Coating: TiN | $H_2 + N_2$ + Titanium Tetrachloride ($TiCl_4$) |
| TiN—$Al_2O_3$—TiCN—TiN | First Coating: TiN | $H_2 + N_2$ + Titanium Tetrachloride ($TiCl_4$) |
| | Second Coating: $Al_2O_3$ | $H_2$+ HCl + Aluminum Chloride ($AlCl_3$) + $CO_2$ + $H_2S$ |
| | Third Coating: TiCN | $H_2 + N_2 + TiCl_4$ + Acetonitrile ($CH_3CN$) or $CH_4$ |
| | Fourth Coating: TiN | $H_2 + N_2$ + Titanium Tetrachloride ($TiCl_4$) |

A milling insert, ADKT150SPDER-47, with GX20™ as carbide substrate was used for the tool wear test. The workpiece materials and the cutting conditions are given in Table 3.

TABLE 3

| Tool Wear Tests | | |
|---|---|---|
| Test | Work Materials | Cutting Conditions |
| Wear Test 1 | Inconel 718<br>475HB | Cutting Speed = 25 meter per minute<br>Feed Rate = 0.08 mm per tooth<br>Depth of Cut = 5 mm |
| Wear Test 2 | Stainless Steel 316<br>176HB | Cutting Speed = 92 meter per minute<br>Feed Rate = 0.10 mm per tooth<br>Depth of Cut = 5 mm |
| Wear Test 3 | Titanium 6V<br>517HB | Cutting speed = 46 meter per minute<br>Feed Rate = 0.10 mm per tooth<br>Depth of Cut = 5 mm |

Figure 2:
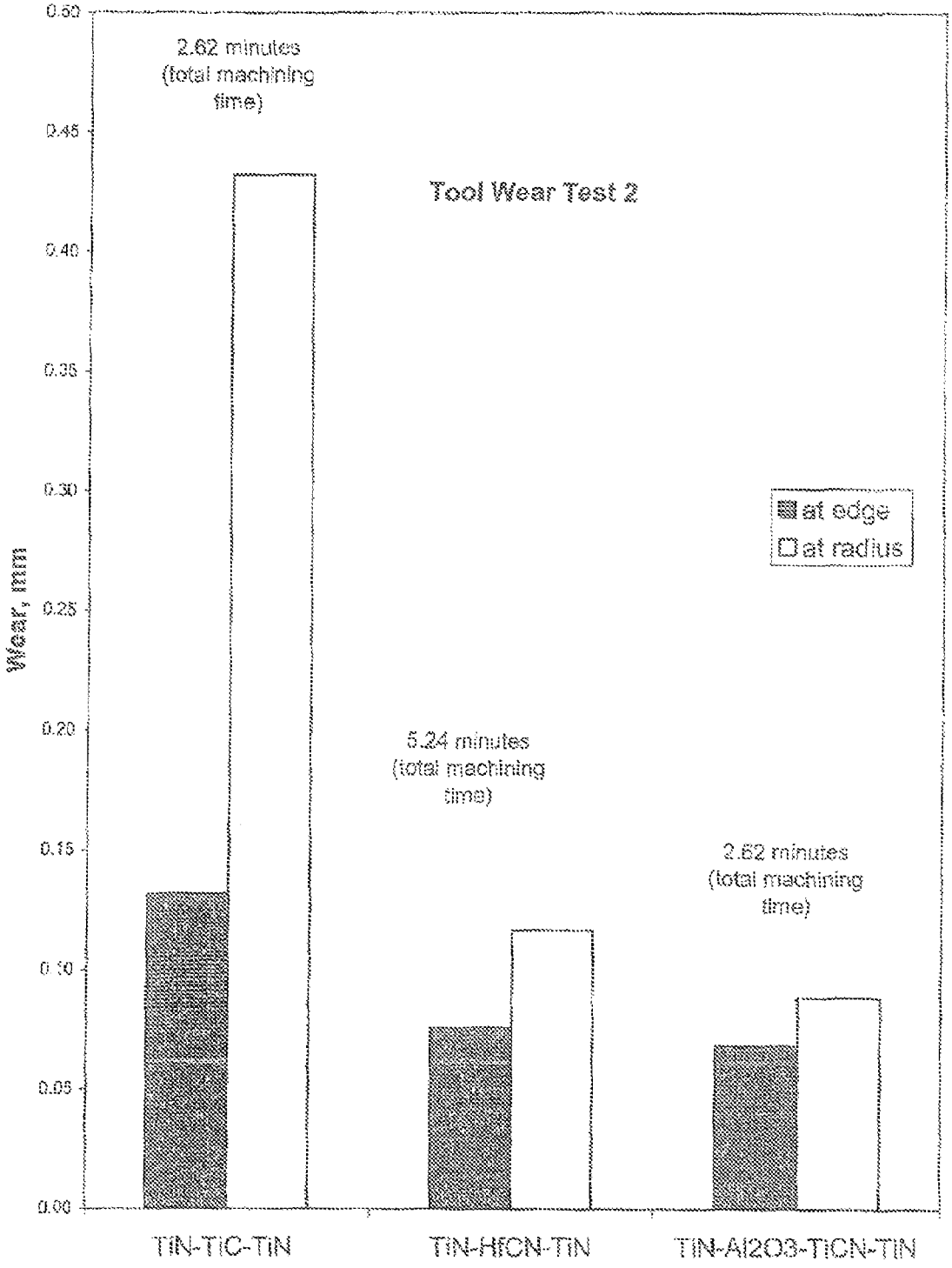
FIG. 2 is a bar graph comparing the experimental results of Tool Wear Test 2 for three cutting inserts with different coatings machining Stainless Steel 316.
Figure 3:
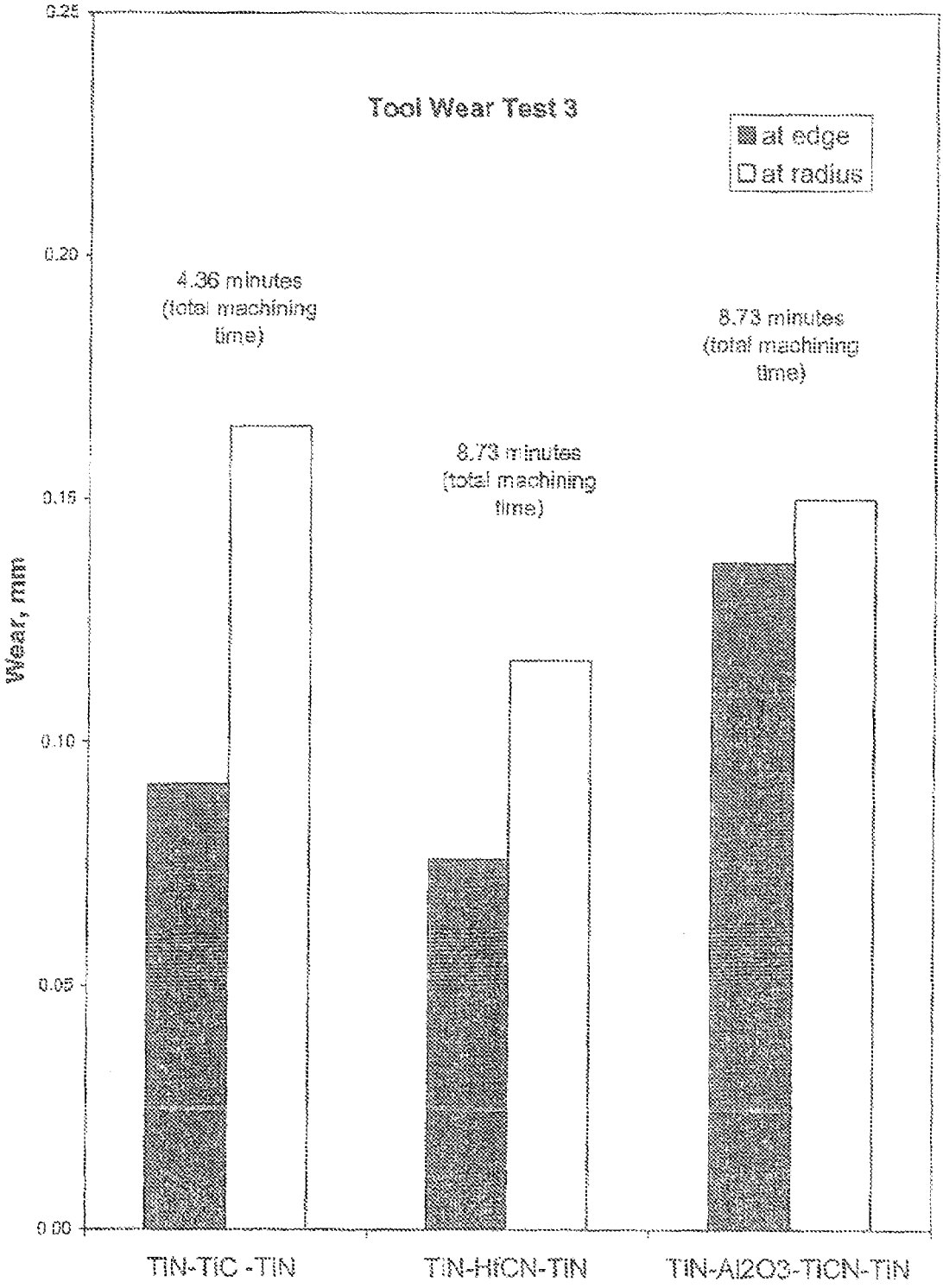
FIG. 3 is a bar graph comparing the experimental results of Tool Wear Test 3 for three cutting inserts with different coatings machining Titanium 6V.

The experimental results including analysis of the effects of wear at both cutting edge and nose radius are shown in FIGS. 1 to 3. The total machining time shown in the figures indicates when a cutting insert either exceeds the tool life or is destroyed during the machining process. The analysis is given below.

In FIG. 1, the results of machining a work piece of Inconel 718 are shown. The nominal composition of Inconel 718 is considered to be a difficult-to-machine work material. For the cutting insert with TiN—TiC—TiN coating, the wear at edge has reached 0.208 mm and the wear at radius reached 0.175 mm after only machining for 5.56 minutes. A cutting insert of the present invention with a multilayer TiN—HfCN—TiN coating demonstrates the best performance with only 0.168 mm wear at edge and 0.136 mm wear at radius after machining for 11.13 minutes. The cutting insert with TiN—$Al_2O_3$—TiCN—TiN coating demonstrated the performance close to that with TiN—HfCN—TiN coating.

In FIG. 2, the results of machining stainless steel 316 with several cutting inserts are shown. The cutting insert with TiN—TiC—TiN coating showed 0.132 mm wear at edge and 0.432 mm wear at radius only after machining for 2.62 minutes. The cutting insert with TiN—$Al_2O_3$—TiCN—TiN coating showed 0.069 mm wear at edge and 0.089 mm wear at radius after machining for 2.62 minutes. Again, the cutting insert with TiN—HfCN—TiN coating demonstrates the best performance with only 0.076 mm wear at edge and 0.117 mm wear at radius after machining for 5.24 minutes which is as twice as the time of other two cutting inserts.

In FIG. 3, the results for machining Ti-6V-4Al titanium alloy, which is also considered to be a difficult-to-machine work material, are shown. The cutting insert with TiN—TiC—TiN coating creates demonstrated 0.091 mm wear at edge and a 0.165 mm wear at radius only after machining for 4.36 minutes. The cutting insert with TiN—$Al_2O_3$—TiCN—TiN coating showed 0.137 mm wear at edge and 0.15 mm wear at radius after machining for 8.73 minutes. Once again, the cutting insert with TiN—HfCN—TiN coating demonstrated the best performances and service life with 0.076 mm wear at edge and 0.117 mm wear at radius after machining for 8.73 minutes.

Example 2

Results of Thermal Crack Test (GX20™ Substrate)

Three cutting inserts comprising a substrate of GX20™ were coated by CVD. The three coatings were a three-layer TiN—TiCN—$Al_2O_3$ coating, a single layer HfN (hafnium nitride) coating, and a single layer HfCN (hafnium carbon nitride) coating. The three coated GX20™ substrates were tested for resistance to thermal cracking.

The cutting conditions used in the thermal crack test are shown as follows.

| | |
|---|---|
| Cutting speed: | Vc = 175 m/min (Thermal Crack Test 1)<br>Vc = 220 m/min (Thermal Crack Test 2) |
| Feed rate | Fz = 0.25 mm/tooth |
| Depth of cut: | DOC = 2.5 mm |
| Work Material: | 4140 steel with a hardness of 300 HB |

Figure 4A:
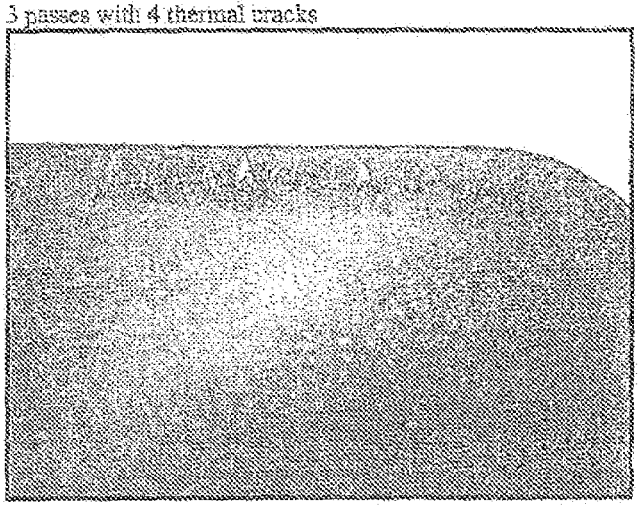
FIGS. 4*a*, 4*b*, and 4*c* are photomicrographs of three cutting inserts with different coatings showing the cracks and wear formed during Thermal Cracking Test 1.
Figure 4B:
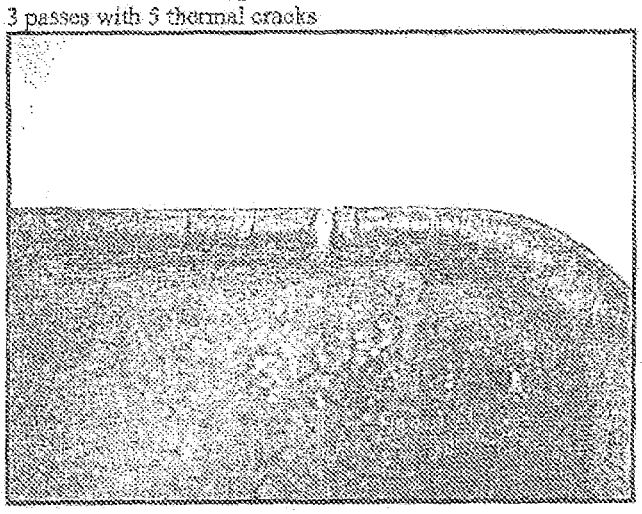
Figure 4C:
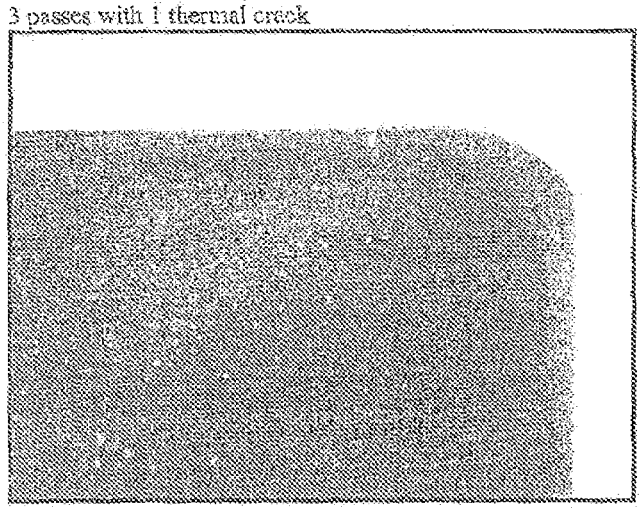
Figure 5A:
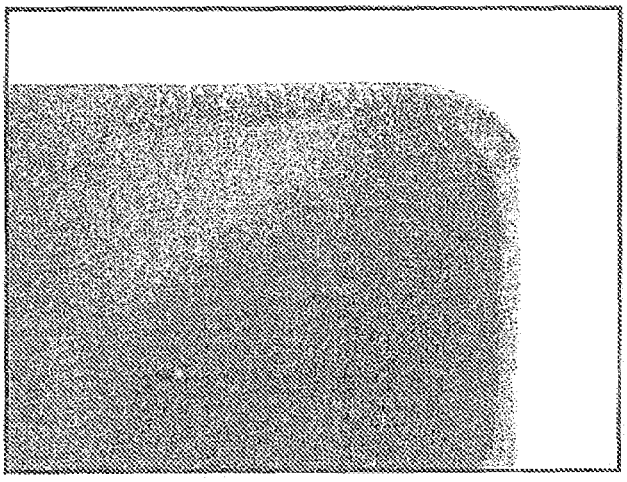
FIGS. 5*a*, 5*b*, and 5*c* are photomicrographs of three cutting inserts with different coatings showing the cracks and wear formed during Thermal Cracking Test 2.
Figure 5B:
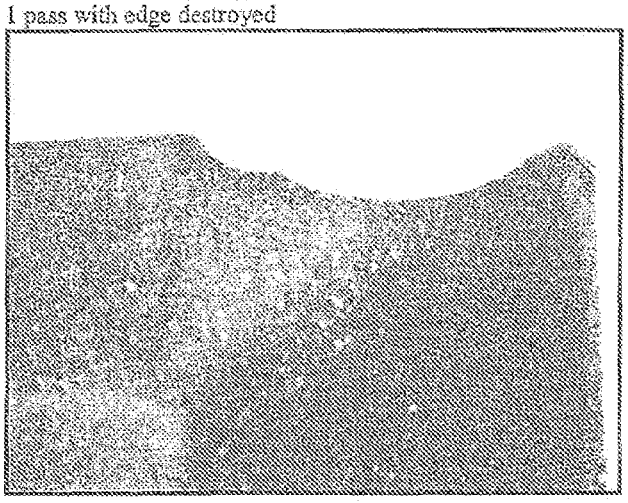
Figure 5C:
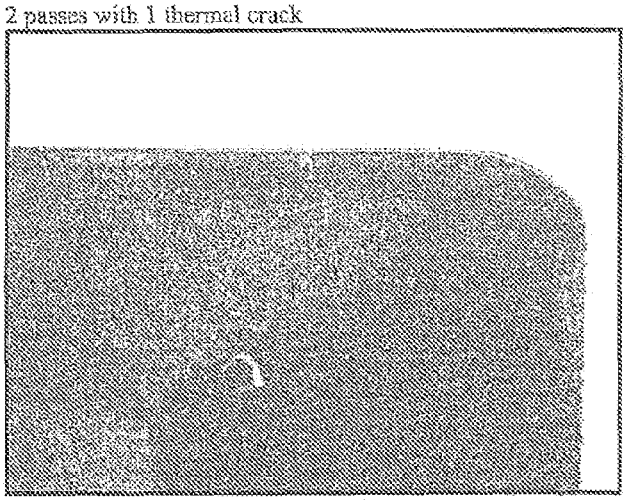

The test results may be compared by the photomicrographs in FIGS. 4 and 5. The photomicrographs of FIG. 4 summarize Thermal Crack Test 1 and show that the cutting insert with a coating of HfN generated 5 thermal cracks in 3 passes of machining (see FIG. 4*b*) while the cutting insert coated with HfCN demonstrated the best performance and generated only 1 thermal crack in 3 passes (see FIG. 4*c*). As a general comparison, the cutting insert with three-layer TiN—TiCN—$Al_2O_3$ coating generated 4 thermal cracks in 3 passes of machining (see FIG. 4*a*).

The photomicrographs of FIG. 5 summarize the results of Thermal Crack Test 2. In Thermal Crack Test 2, the cutting speed was increased to 220 meter per minute. The edge of the cutting insert with single layer coating HfN was destroyed after only 1 pass of machining (see FIG. 4*b*). The cutting insert with three-layer coating TiN—TiCN—$Al_2O_3$ generated 12 thermal cracks in 2 passes of machining (see FIG. 4*a*). Once again, the cutting insert with single layer coating HfCN generated only 1 thermal crack in 2 passes of machining. In the comparison between Thermal Crack Test 1 and Thermal Crack Test 2, it becomes clear that at higher cutting speeds, there is a larger difference in performance between the cutting insert with single layer HfCN as compared with the cutting inserts with single layer coating HfN and three-layer coating TiN—TiCN—$Al_2O_3$.

The results from both wear test and thermal crack test directly indicate that it is the unique combination of hafnium-carbon-nitride based coating and ruthenium-featured carbide substrate that demonstrates the best performance in machining. The hafnium-carbon-nitride based coating may be the intermediate layer coating in a case of multilayer coating or just as a single layer coating.

We claim:

1. A cutting tool, comprising:

a substrate comprising metal carbide particles and a binder, wherein the binder comprises ruthenium; and at least one wear resistant coating comprising hafnium carbon nitride.

2. The cutting tool of claim 1, wherein the wear resistant coating comprising hafnium carbon nitride has a thickness from 1 to 10 microns.

3. The cutting tool of claim 1, wherein the binder further comprises at least one of iron, nickel and cobalt.

4. The cutting tool of claim 1, wherein the binder further comprises cobalt.

5. The cutting tool of claim 3 or 4, wherein the concentration of ruthenium in the binder is from 1% to 30%, by weight.

6. The cutting tool of claim 5, wherein the concentration of ruthenium in the binder is from 4% to 30%, by weight.

7. The cutting tool of claim 6, wherein the concentration of ruthenium in the binder is from 8% to 20%, by weight.

8. The cutting tool of claim 7, wherein the concentration of ruthenium in the binder is from 10% to 15%, by weight.

9. The cutting tool of claim 1, comprising at least one additional coating comprising at least one of a metal carbide, a metal nitride, a metal silicon or a metal oxide of a metal selected from groups IIIA, IVB, VB, and VIB of the periodic table, wherein the hafnium carbon nitride coating comprises at least one of a first coating on the substrate, an intermediate coating on the substrate, and a final coating on the substrate.

10. The cutting tool of claim 9, wherein the at least one additional coating is selected from titanium nitride (TiN), titanium carbonitride (TiCN), titanium carbide (TiC), titanium aluminum nitride (TiAlN), titanium aluminum nitride plus carbon (TiAlN+C), aluminum titanium nitride (AlTiN), aluminum titanium nitride plus carbon (AlTiN+C), titanium aluminum nitride plus tungsten carbide/carbon (TiAlN+WC/C), aluminum titanium nitride (AlTiN), aluminum titanium nitride plus carbon (AlTiN+C), aluminum titanium nitride plus tungsten carbide/carbon (AlTiN+WC/C), aluminum oxide ($Al_2O_3$), α-alumina oxide, titanium diboride ($TiB_2$), tungsten carbide carbon (WC/C), chromium nitride (CrN), aluminum chromium nitride (AlCrN), zirconium nitride (ZrN), zirconium carbon nitride (ZrCN), boron nitride (BN), and boron carbon nitride (BCN).

11. The cutting tool of claim 10, wherein any of the at least one additional coating has a thickness from 2 to 6 micrometers.

12. The cutting tool of claim 1, wherein the wear resistant coating comprising hafnium carbon nitride is one of an only coating, a first coating, an intermediate coating, and a top coating.

13. The cutting tool of claim 1, wherein the metal carbide particles of the substrate comprise at least one transition metal selected from titanium, chromium, vanadium, zirconium, hafnium, tantalum, molybdenum, niobium, and tungsten.

14. The cutting tool of claim 3 or 4, wherein the binder further comprises an alloying agent selected from tungsten, titanium, tantalum, niobium, chromium, molybdenum, boron, carbon, silicon, ruthenium, rhenium, manganese, aluminum, and copper.

15. The cutting tool of claim 1, wherein the metal carbide particles of the substrate comprise tungsten carbide.

16. The cutting tool of claim 1, wherein the wear resistant coating consists essentially of hafnium carbon nitride.

17. The cutting tool of claim 16, wherein the substrate comprises 2 to 40 weight percent of the binder and 60 to 98 weight percent of the metal carbide particles, and wherein the metal carbide particles comprise tungsten carbide particles.

18. The cutting tool of claim 1, wherein the metal carbide particles comprise tungsten carbide particles having an average grain size of 0.3 to 10 μm.

19. The cutting tool of claim 1, wherein the metal carbide particles comprise tungsten carbide particles having an average grain size of 0.5 to 10 μm.

20. A method of coating a cutting tool, comprising: applying a wear resistant coating of hafnium carbon nitride on a cutting tool, wherein the substrate comprises tungsten carbide particles in a binder and the binder comprises ruthenium.

21. The method of claim 20, wherein the wear resistant coating has a thickness from 1 to 6 microns.

22. The method of claim 20, wherein the binder comprises at least one of iron, nickel and cobalt.

23. The method of claim 22, wherein the binder is cobalt.

24. The method of claim 23, wherein the concentration of ruthenium in the binder is from 1% to 30%, by weight.

25. The method of claim 24, wherein the concentration of ruthenium in the binder is from 4% to 30%, by weight.

26. The method of claim 25, wherein the concentration of ruthenium in the binder from 8% to 20%, by weight.

27. The method of claim 26, wherein the concentration of ruthenium in the binder from 10% to 15%, by weight.

28. The method of claim 20, comprising treating the cutting tool prior to coating the substrate.

29. The method of claim 28, wherein treating the cutting tool prior to coating comprises at least one of electropolishing, microblasting, wet blasting, grinding, brushing, jet abrading and compressed air blasting.

30. The method of claim 20, wherein a coating is formed on at least a portion of the substrate.

31. The method of claim 20, comprising treating the coating on the substrate by at least one of blasting, shot peening, compressed air blasting, and brushing.

32. The method of claim 20, comprising applying additional coatings on the substrate by physical vapor deposition.

33. The method of claim 20, comprising applying additional coatings on the substrate by chemical vapor deposition.

34. The method of claim 20, comprising coating the cutting insert with at least one of a metal carbide, a metal nitride, a metal silicon and a metal oxide of a metal selected from groups IIIA, IVB, VB, and VIB of the periodic table.

35. The method of claim 34, wherein the coating comprises at least one of titanium nitride (TiN), titanium carbonitride (TiCN), titanium aluminum nitride (TiAlN), titanium aluminum nitride plus carbon (TiAlN+C), aluminum titanium nitride (AlTiN), aluminum titanium nitride plus carbon (AlTiN+C), titanium aluminum nitride plus tungsten carbide/carbon (TiAlN+WC/C), aluminum titanium nitride (AlTiN), aluminum titanium nitride plus carbon (AlTiN+C), aluminum titanium nitride plus tungsten carbide/carbon (AlTiN+WC/C), aluminum oxide ($Al_2O_3$), titanium diboride ($TiB_2$), tungsten carbide carbon (WC/C), chromium nitride (CrN), aluminum chromium nitride (AlCrN), zirconium nitride (ZrN), zirconium carbon nitride (ZrCN), boron nitride (BN), or boron carbon nitride (BCN).

36. The method of claim 34, wherein each coating has a thickness from 1 to 10 micrometers.

37. A cutting tool, comprising:

a substrate comprising metal carbide particles and a binder, wherein the binder comprises ruthenium; and at least one wear resistant coating on the substrate, wherein the at least one wear resistant coating consists essentially of zirconium carbon nitride (ZrCN), or boron carbon nitride (BCN).

38. The cutting tool of claim 37, wherein the at least one wear resistant coating has a thickness from 1 to 10 microns.

39. The cutting tool of claim 37, wherein the binder further comprises at least one of iron, nickel and cobalt.

40. The cutting tool of claim 39, wherein the binder further comprises cobalt.

41. The cutting tool of claim 37, wherein the concentration of ruthenium in the binder is from 1% to 30%, by weight.

42. The cutting tool of claim 41, wherein the concentration of ruthenium in the binder is from 4% to 30%, by weight.

43. The cutting tool of claim 42, wherein the concentration of ruthenium in the binder is from 8% to 20%, by weight.

44. The cutting tool of claim 43, wherein the concentration of ruthenium in the binder is from 10% to 15%, by weight.

45. The cutting tool of claim 37, comprising at least one additional coating, wherein the at least one additional coating comprises at least one of a metal carbide, a metal nitride, a metal silicon and a metal oxide of a metal selected from groups IIIA, IVB, VB, and VIB of the periodic table; wherein the wear resistant coating consisting essentially of one of zirconium carbon nitride (ZrCN) and boron carbon nitride (BCN) comprises one or more of a first coating on the substrate, an intermediate coating on the substrate, and a final coating on the substrate.

46. The cutting tool of claim 45, wherein the at least one additional coating comprises at least one of titanium nitride (TiN), titanium carbide (TiC), titanium carbonitride (TiCN), titanium aluminum nitride (TiAlN), titanium aluminum nitride plus carbon (TiAlN+C), aluminum titanium nitride (AlTiN), aluminum titanium nitride plus carbon (AlTiN+C), titanium aluminum nitride plus tungsten carbide/carbon (TiAlN+WC/C), aluminum titanium nitride (AlTiN), aluminum titanium nitride plus carbon (AlTiN+C), aluminum titanium nitride plus tungsten carbide/carbon (AlTiN+WC/C), aluminum oxide ($Al_2O_3$), $\alpha$-alumina oxide, titanium diboride ($TiB_2$), tungsten carbide carbon (WC/C), chromium nitride (CrN), aluminum chromium nitride (AlCrN), and hafnium carbon nitride (HfCN).

* * * * *

UNITED STATES PATENT AND TRADEMARK OFFICE

CERTIFICATE OF CORRECTION

PATENT NO. : 8,512,882 B2
APPLICATION NO. : 11/676394
DATED : August 20, 2013
INVENTOR(S) : Bost et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1089 days.

Signed and Sealed this
Twenty-seventh Day of January, 2015

Michelle K. Lee

Michelle K. Lee
*Deputy Director of the United States Patent and Trademark Office*